US010711559B2

(12) United States Patent
Vasques et al.

(10) Patent No.: US 10,711,559 B2
(45) Date of Patent: Jul. 14, 2020

(54) DOWNHOLE EXPANDABLE METAL TUBULAR

(71) Applicant: Welltec Oilfield Solutions AG, Zug (CH)

(72) Inventors: Ricardo Reves Vasques, Allerød (DK); Line Bergmann, Allerød (DK); Lars Staehr, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 645 days.

(21) Appl. No.: 15/315,926

(22) PCT Filed: Jun. 4, 2015

(86) PCT No.: PCT/EP2015/062495
§ 371 (c)(1),
(2) Date: Dec. 2, 2016

(87) PCT Pub. No.: WO2015/185683
PCT Pub. Date: Dec. 10, 2015

(65) Prior Publication Data

US 2017/0101846 A1 Apr. 13, 2017

(30) Foreign Application Priority Data

Jun. 4, 2014 (EP) ..... 14171117

(51) Int. Cl.
*E21B 33/12* (2006.01)
*E21B 33/128* (2006.01)
(Continued)

(52) U.S. Cl.
CPC ..... *E21B 33/1208* (2013.01); *E21B 33/128* (2013.01); *E21B 33/1216* (2013.01); *E21B 33/127* (2013.01); *E21B 34/06* (2013.01)

(58) Field of Classification Search
CPC ..... E21B 2033/005; E21B 33/1208; E21B 33/1212; E21B 33/122; E21B 33/126; E21B 33/128; E21B 34/06; E21B 33/1216
See application file for complete search history.

(56) References Cited

U.S. PATENT DOCUMENTS 3,784,214 A * 1/1974 Tamplen ..... E21B 33/1208 277/341
4,753,444 A * 6/1988 Jackson ..... C08K 7/06 166/120
(Continued)

FOREIGN PATENT DOCUMENTS

EP 2 644 820 10/2013
RU 2 083 798 C1 7/1997
(Continued)

OTHER PUBLICATIONS

Office Action of Substantive Examination dated Jan. 18, 2019 in Russian Application No. 2016150307/03(080742), with English translation, 22 pages.
(Continued)

*Primary Examiner* — Robert E Fuller
*Assistant Examiner* — Christopher J Sebesta
(74) *Attorney, Agent, or Firm* — Nixon & Vanderhye P.C.

(57) ABSTRACT

The present invention relates to a downhole expandable metal tubular having an axial extension, to be expanded in a well downhole to abut against an inner face of a casing or a borehole, comprising a first section having a first outer diameter, two circumferential projections having a second outer diameter which is larger than the first outer diameter, a second section arranged between the two projections, each projection having an inclined face tapering from the second outer diameter towards the second section, wherein the second section has a third outer diameter which is smaller
(Continued)

than the first outer diameter in an unexpanded condition, and a sealing element is arranged between the projections opposite the second section, so that during expansion the second section bulges more radially outwards than the first section, forcing the sealing element radially outwards. Furthermore, the present invention relates to an annular barrier, a downhole completion and a sealing expansion method.

10 Claims, 13 Drawing Sheets

(51) Int. Cl.
*E21B 33/127* (2006.01)
*E21B 34/06* (2006.01)

(56) References Cited

U.S. PATENT DOCUMENTS 5,542,473 A * 8/1996 Pringle ..... E21B 23/01 166/120
5,941,313 A * 8/1999 Arizmendi ..... E21B 33/128 166/387
2002/0121743 A1* 9/2002 Crow ..... E21B 33/1208 277/343
2004/0055758 A1 3/2004 Brezinski et al.
2005/0161232 A1 7/2005 Patel et al.
2009/0242215 A1* 10/2009 Eatwell ..... E21B 33/128 166/387
2012/0067565 A1 3/2012 Chalker et al.
2014/0319783 A1* 10/2014 Gomez ..... F16J 15/068 277/649

FOREIGN PATENT DOCUMENTS

RU 2 101 465 C1 1/1998
RU 2 224 872 C1 2/2004
RU 2 282 711 C1 8/2006
WO WO 94/20728 9/1994

OTHER PUBLICATIONS

International Search Report and Written Opinion of the ISA for PCT/EP2015/062495, dated Nov. 17, 2015, 18 pages.
Extended Search Report for EP 14171117.6, dated Oct. 31, 2014, 7 pages.

* cited by examiner

DOWNHOLE EXPANDABLE METAL TUBULAR

This application is the U.S. national phase of International Application No. PCT/EP2015/062495 filed 4 Jun. 2015, which designated the U.S. and claims priority to EP Patent Application No. 14171117.6 filed 4 Jun. 2014, the entire contents of each of which are hereby incorporated by reference.

FIELD OF THE INVENTION

The present invention relates to a downhole expandable metal tubular having an axial extension, to be expanded in a well downhole to abut an inner face of a casing or a borehole. Furthermore, the present invention relates to an annular barrier, a downhole completion and a sealing expansion method.

BACKGROUND ART

When isolating one production zone from another, one of the challenges is that the borehole wall is not smooth and even. Therefore, several attempts have been made to provide annular barriers capable of providing proper sealing towards such uneven surfaces.

One way of providing zone isolation is to use annular barriers comprising expandable sleeves arranged on the outside of the well tubular structure. Once expanded, the sleeve abuts the inner surface of the borehole wall in order to provide the zone isolation. Sealing means are arranged on the outside of the sleeve for abutting the wall of the borehole and improving the sealing ability of the annular barrier. However, the sealing means do not always provide sufficient sealing, but the sealing means cannot be enlarged since they will then also enlarge the outer diameter of the annular barrier, and as the annular barrier is submerged down the borehole, such enlarged sealing means will bump into the borehole wall and thus be damaged.

SUMMARY OF THE INVENTION

It is an object of the present invention to wholly or partly overcome the above disadvantages and drawbacks of the prior art. More specifically, it is an object to provide an improved downhole expandable metal tubular having improved sealing properties.

The above objects, together with numerous other objects, advantages and features, which will become evident from the below description, are accomplished by a solution in accordance with the present invention by a downhole expandable metal tubular having an axial extension, to be expanded in a well downhole to abut an inner face of a casing or a borehole, comprising:

- a first section having a first outer diameter,
- two circumferential projections having a second outer diameter which is larger than the first outer diameter, and
- a second section arranged between the two projections, each projection having an inclined face tapering from the second outer diameter towards the second section, wherein the second section has a third outer diameter which is smaller than the first outer diameter in an unexpanded condition, and a sealing element is arranged between the projections opposite the second section so that during expansion, the second section bulges more radially outwards than the first section, forcing the sealing element radially outwards.

The expandable metal tubular as described above may have an inner diameter which is the same along the axial extension in the unexpanded condition.

Moreover, the sealing element may be ring-shaped.

Further, the sealing element may have a trapezoidal cross-sectional shape.

Also, the trapezoidal cross-sectional shape may substantially match a cross-sectional shape of the second section and the two projections.

In addition, the first section may have a first thickness and the second section may have a second thickness, the second thickness being at least 25% smaller than the first thickness, preferably at least 40% smaller than the first thickness.

The inclined face of the projections may form an angle in relation to the axial extension, said angle being at least 110°, preferably 135°.

Moreover, the downhole expandable metal tubular as described above may further comprise a plurality of second sections separated by a first section.

Furthermore, as the sealing element is arranged in the second section, the second section including the sealing element may have an outer diameter which is substantially the same as the second outer diameter of the projections. Also, the sealing element may be freely arranged opposite the second section.

This sealing element may be made of an elastomer, rubber, polytetrafluoroethylene (PTFE) or another polymer.

Furthermore, the downhole expandable metal tubular may be corrugated, thereby forming projections and grooves, and the downhole expandable metal tubular has a substantially even thickness.

Moreover, a sealing element may be arranged in at least one of the grooves.

Also, the grooves may have a smaller extension along the axial extension than the projections.

In an embodiment, the downhole expandable metal tubular may end in projections which are end projections.

The projections between the grooves may be smaller in extension than the end projections.

Further, the projections may have an axial extension.

In addition, the projections may have a straight part substantially parallel to the axial extension.

Moreover, a sealing element may be arranged in at least one of the grooves.

Additionally, the downhole expandable metal tubular in cross-section along the axial extension may have a corrugated square or trapezoidal shape.

Furthermore, a sealing element may be arranged in each groove.

Moreover, the sealing element and a split ring-shaped retaining element may be arranged between the projections, the split ring-shaped retaining element forming a back-up for the sealing element.

In addition, the sealing element and a split ring-shaped retaining element may be arranged in at least one of the grooves, the split ring-shaped retaining element forming a back-up for the sealing element.

Also, the split ring-shaped retaining element may have more than one winding so that when the expandable tubular is expanded from the first outer diameter to the second outer diameter, the split ring-shaped retaining element partly unwinds.

Moreover, the split ring-shaped retaining element may abut the sealing element.

Further, the split ring-shaped retaining element may preferably be made of a material having a yield strength of at least 69 MPa, preferably at least 100 MPa.

Additionally, the split ring-shaped retaining element may unwind by less than one winding when the expandable tubular is expanded from the first outer diameter to the second outer diameter.

Also, the split ring-shaped retaining element may have more than one winding in the second outer diameter of the downhole expandable metal tubular.

Furthermore, the split ring-shaped retaining element may have a width in the longitudinal extension, the width being substantially the same in the first outer diameter and the second outer diameter of the downhole expandable metal tubular.

Moreover, the split ring-shaped retaining element may have a plurality of windings.

Additionally, an intermediate element may be arranged between the split ring-shaped retaining element and the sealing element.

Furthermore, each projection may have an inclined face tapering from the second section towards the second outer diameter or tapering from the groove towards the sealing element.

Further, the downhole expandable metal tubular may be a patch to be expanded within a casing or well tubular structure in a well, a liner hanger to be at least partly expanded within a casing or well tubular structure in a well, or a casing to be at least partly expanded within another casing.

The present invention also relates to an annular barrier to be expanded in an annulus between a well tubular structure and an inner face of a borehole or a casing downhole for providing zone isolation between a first zone and a second zone of the borehole, the annular barrier comprising:

- a tubular part adapted to be mounted as part of the well tubular structure,
- a downhole expandable metal tubular according to any of the preceding claims, surrounding the tubular part and having an outer face facing the inner face of the borehole or the casing, each end of the downhole expandable metal tubular being connected with the tubular part, and
- an annular space between the downhole expandable metal tubular and the tubular part.

Said annular space may comprise a compound adapted to expand the annular space.

Moreover, the compound may comprise at least one thermally decomposable compound adapted to generate gas or super-critical fluid upon decomposition.

Also, the compound may comprise nitrogen.

The compound may be selected from a group consisting of: ammonium dichromate, ammonium nitrate, ammonium nitrite, barium azide, sodium nitrate, or a combination thereof.

Further, the compound may be present in the form of a powder, a powder dispersed in a liquid or a powder dissolved in a liquid.

Additionally, an opening may be arranged in the tubular part opposite the expandable metal tubular for letting pressurised fluid into the annular space to expand the expandable metal tubular.

A valve may be arranged in the opening.

Moreover, the valve may be a check valve.

One or both ends of the expandable metal tubular may be connected with the tubular part by means of connection parts.

Also, a sleeve may be arranged between the expandable metal tubular and the tubular part, the sleeve being connected with the tubular part and the expandable metal tubular, thus dividing the annular space into a first space section and a second space section.

Furthermore, the expandable metal tubular may have an aperture providing fluid communication between the first or the second zone and one of the space sections.

The present invention also relates to a downhole completion comprising:

- a well tubular structure, and
- a downhole expandable metal tubular as described above.

Further, the present invention relates to a downhole completion comprising:

- a well tubular structure, and
- an annular barrier as described above, wherein the tubular part of the annular barrier is mounted as part of the well tubular structure.

Moreover, the present invention relates to a sealing expansion method comprising the steps of:

- arranging a downhole expandable metal tubular as described above opposite an area to be sealed off, and
- expanding the downhole expandable metal tubular to abut the area, and thereby sealing off the area.

Finally, the present invention relates to a sealing expansion method comprising the steps of:

- arranging a downhole completion as described above, and
- expanding the downhole expandable metal tubular of the annular barrier to abut a casing or a borehole in order to provide zone isolation between a first zone and a second zone of the casing or the borehole.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
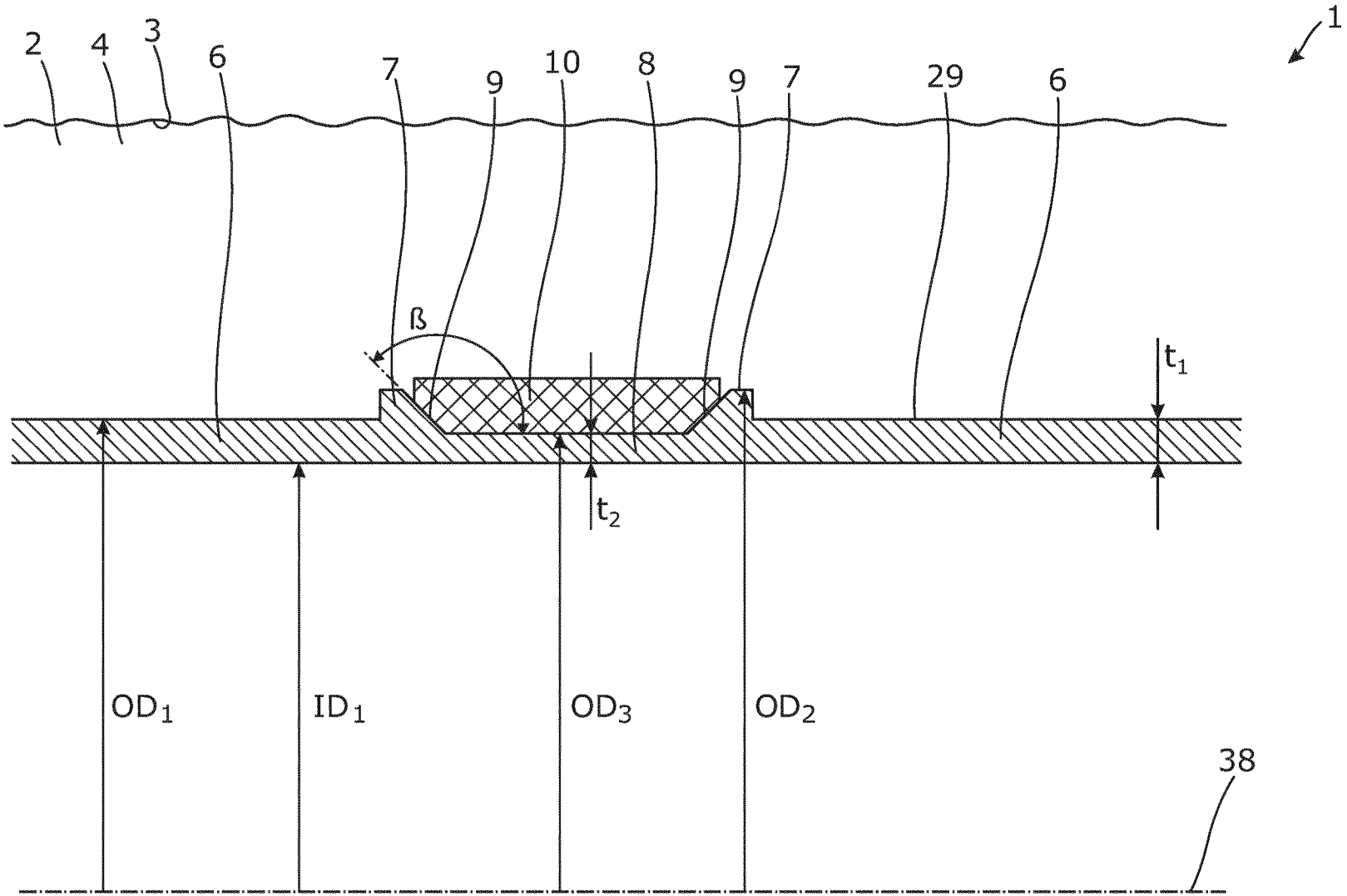
FIG. 1 shows a cross-sectional, partial view of a downhole expandable metal tubular in an unexpanded condition.
Figure 2:
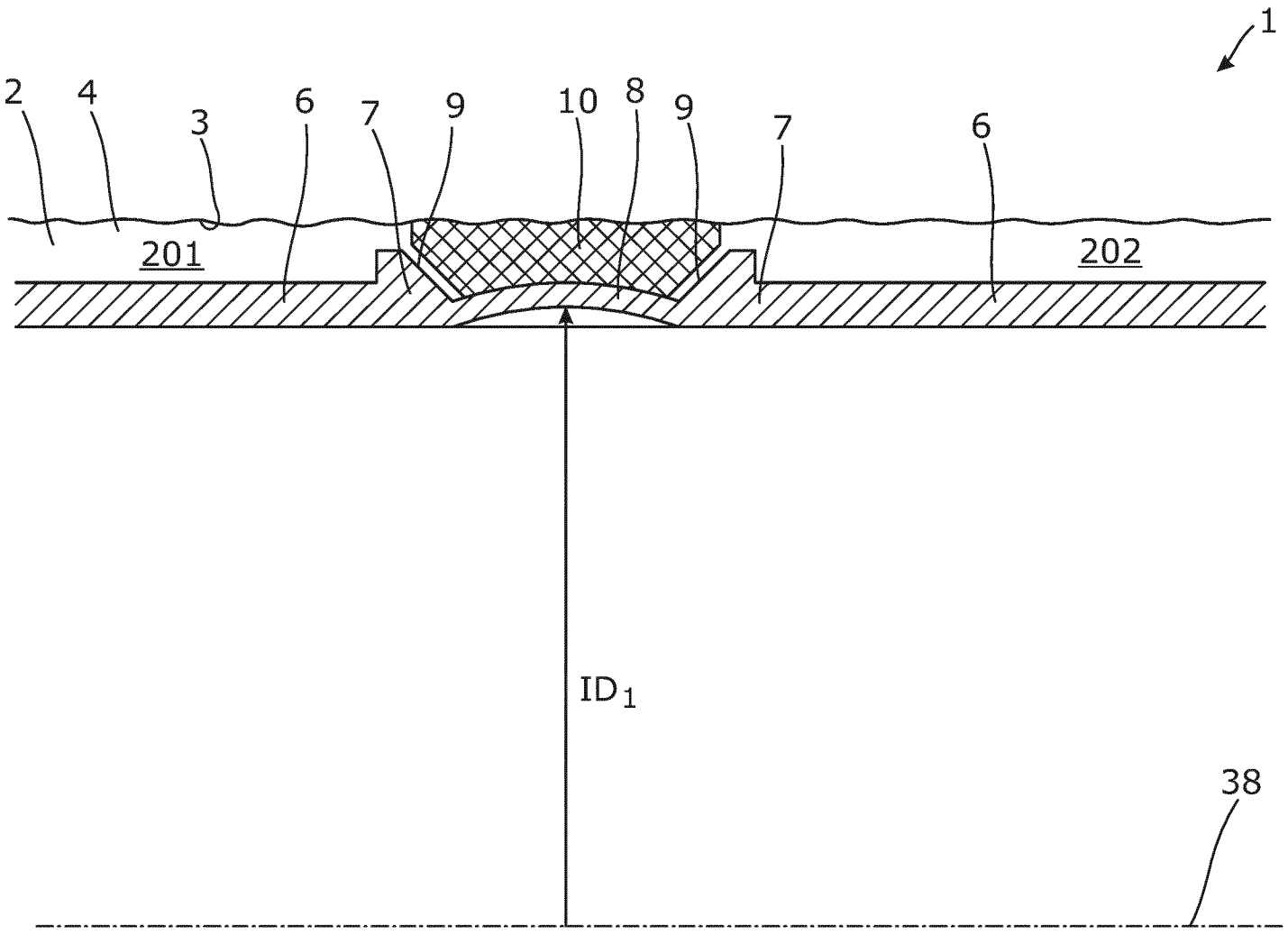
FIG. 2 shows a cross-sectional, partial view of the downhole expandable metal tubular of FIG. 1 in an expanded condition.

FIG. 1 shows a downhole expandable metal tubular 1 to be expanded in a well 2 downhole to abut an inner face 3 of a borehole 4. The downhole expandable metal tubular 1 comprises a first section 6 having a first outer diameter $OD_1$ and two circumferential projections 7 having a second outer diameter $OD_2$ which is larger than the first outer diameter. Furthermore, the downhole expandable metal tubular 1 comprises a second section 8 arranged between the two projections 7, each projection having an inclined face 9 tapering from the second outer diameter $OD_2$ towards the second section 8. The second section 8 has a third outer diameter $OD_3$ which is smaller than the first outer diameter $OD_1$ in an unexpanded condition. Furthermore, a sealing element 10 is arranged between the projections 7 opposite the second section so that during expansion, the second section 8 bulges more radially outwards than the first section 6, forcing the sealing element radially outwards, as shown in FIG. 2. In FIG. 2, the downhole expandable metal tubular 1 has been expanded so that the sealing element 10 is forced towards the inner face 3 of the borehole 4 and thus provides a firm seal so that fluid from a first zone 201 is prevented from passing to a second zone 202.

By having the second section 8 with a substantially smaller thickness opposite the sealing element 10, the downhole expandable metal tubular 1 is more capable of sealing towards the inner face 3 of the borehole 4. This is due to the fact that the second section 8 bulges more outwards when the downhole expandable metal tubular 1 is expanded by means of fluid pressing directly or indirectly on the inner face of the downhole expandable metal tubular 1. The thinner section is more inclined to yield than the thicker first sections 6 and the projections 7.

As can be seen in FIG. 1, the expandable metal tubular 1 has an inner diameter $ID_1$ which is the same along its axial extension in the unexpanded condition, and in FIG. 2, the inner diameter $ID_1$ opposite the second section 8 is increased in relation to the first section 6. The sealing element 10 is ring-shaped, and thus, if the second section 8 does not bulge outwards, the sealing element decreases as the downhole expandable metal tubular 1 is expanded. But by having the bulged second section 8, the sealing element 10 is forced radially outwards and is thus still capable of sealing, also after expansion of the downhole expandable metal tubular 1.

In FIGS. 1 and 2, the sealing element 10 has a trapezoidal cross-sectional shape corresponding to the shape formed by the projections 7 and thus substantially matching a cross-sectional shape of the second section 8 and the two projections. The first sections 6 have a first thickness $t_1$ and the second section 8 has a second thickness $t_2$ which is at least 25% smaller than the first thickness, preferably at least 40% smaller than the first thickness. In FIG. 1, the inclined face 9 of the projections 7 forms an angle β in relation to the axial extension, said angle being at least 110°, preferably 135°.

Figure 3:
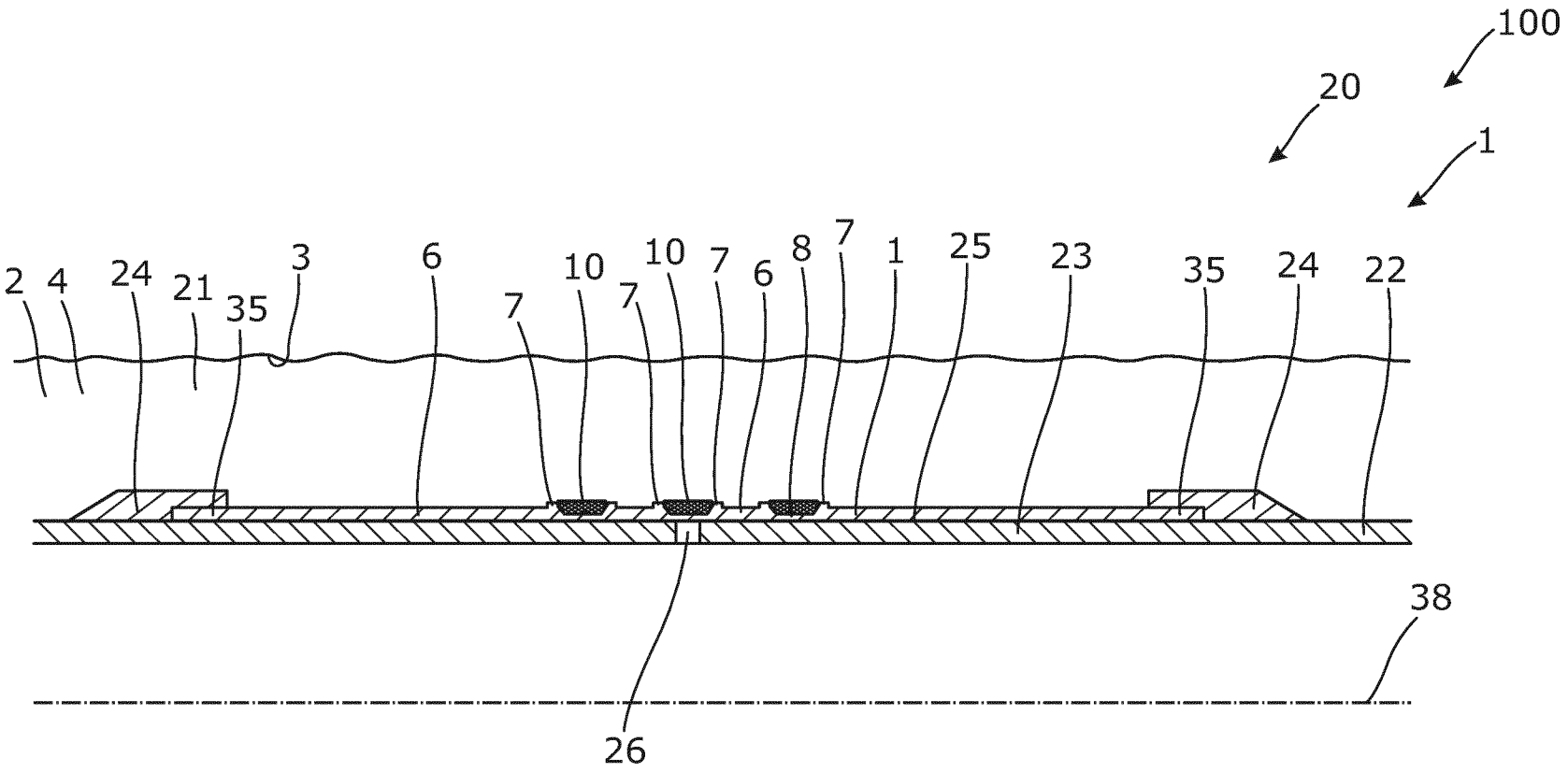
FIG. 3 shows a cross-sectional view of an annular barrier mounted as part of a well tubular structure.

In FIG. 3, the downhole expandable metal tubular 1 is part of an annular barrier 20 and comprises three second sections 8 separated by a first section 6. The annular barrier 20 is to be expanded in an annulus 21 between a well tubular structure 22 and the inner face 3 of the borehole 4 or a casing (not shown) downhole to provide zone isolation between a first zone and a second zone of the borehole 4 by dividing the annulus 21 into two parts, i.e. the first zone and the second zone. The annular barrier 20 comprises a tubular part 23 adapted to be mounted as part of the well tubular structure 22 and surrounds the tubular part and has an outer face 29 facing the inner face 3 of the borehole 4. Each end 35 of the downhole expandable metal tubular 1 is connected with the tubular part 23 by means of connection parts 24 defining an annular space 25 between the downhole expandable metal tubular and the tubular part 23. The annular barrier 20 may be expanded by letting pressurised fluid into the space through the opening 26 in the tubular part 23 or by the annular space 25 comprising a compound adapted to expand the annular space in that the compound comprises at least one thermally decomposable compound or chemical reactant adapted to generate gas or super-critical fluid upon decomposition.

As can be seen in FIG. 1, the sealing element 10 is arranged in the second section 8, and the second section including the sealing element has an outer diameter which is substantially the same as the second outer diameter of the projections 7 in the unexpanded condition of the downhole expandable metal tubular 1. The sealing element 10 is slidably arranged around the second section 8 so that the sealing element can move freely and is thus not fastened to the second section by means of glue or similar fastening methods. The sealing element may be made of an elastomer, rubber, polytetrafluoroethylene (PTFE) or another polymer.

Figure 4:
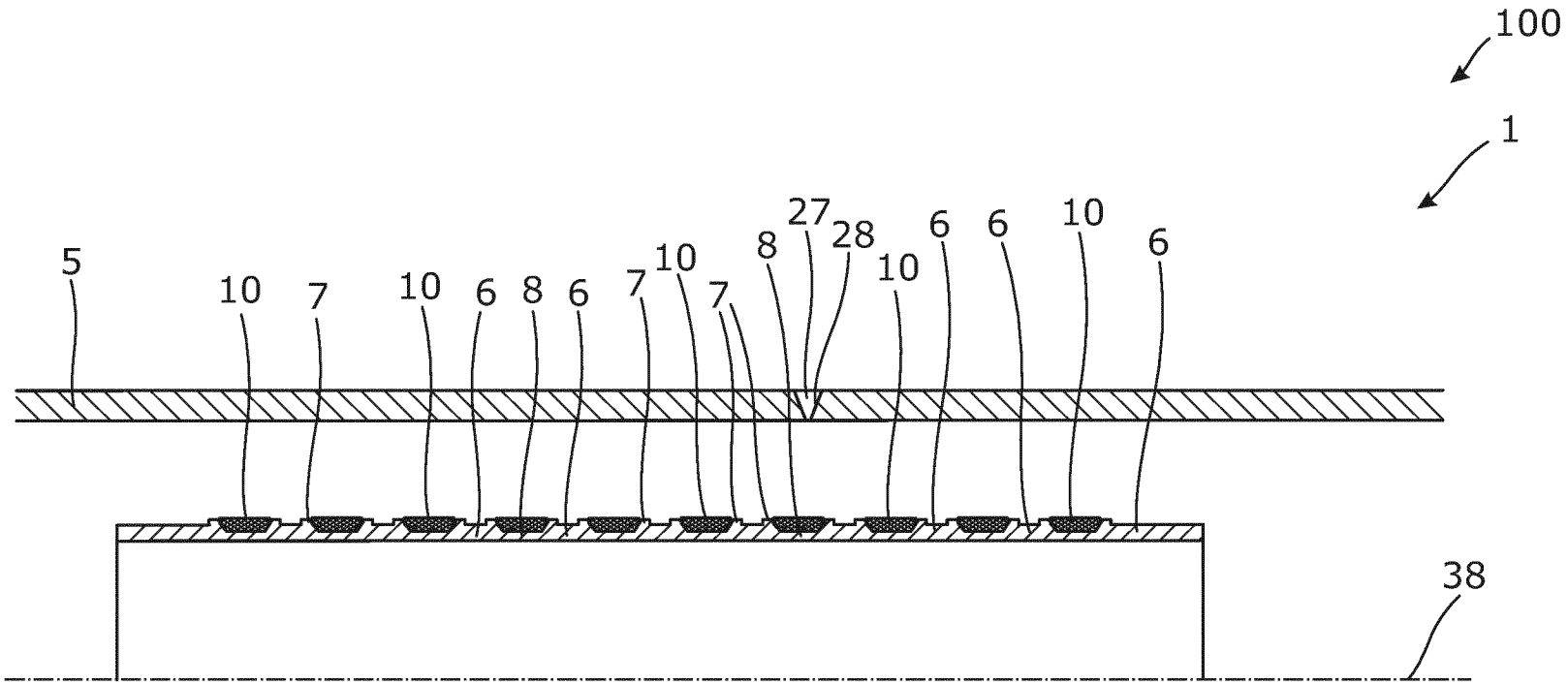
FIG. 4 shows a cross-sectional view of a patch to be expanded within a well tubular structure for sealing off an area, such as a leak.

In FIG. 4, the downhole expandable metal tubular 1 is a patch to be expanded within a casing 5 already present in the well. The downhole expandable metal tubular 1 is expanded inside the casing 5 in order to seal off an area 28, such as a leak 27. The downhole expandable metal tubular 1 comprises a plurality of second sections 8 divided by first sections 6, and each second section 8 is surrounded by projections 7 in such a way that a projection 7 is arranged in each end of each second section 8. The downhole expandable metal tubular 1 is expanded by an expansion tool (not shown) which may be an expandable mandrel drawn through the downhole expandable metal tubular or a hydraulic inflatable bladder arranged inside the downhole expandable metal tubular 1. The bladder is made of elastomer and is thus capable of conforming to the inside of the downhole expandable metal tubular. Thus, fluid inside the bladder indirectly presseson the tubular, and the second section is thus forced to bulge outwards. Even though not shown, the downhole expandable metal tubular may also be a liner hanger to be at least partly expanded within a casing or well tubular structure in a well, or a casing to be at least partly expanded within another casing.

The compound comprised in the annular space of the annular barrier may be nitrogen. The compound may be selected from a group consisting of: ammonium dichromate, ammonium nitrate, ammonium nitrite, barium azide, sodium nitrate, or a combination thereof. The compound may be present in the form of a powder, a powder dispersed in a liquid or a powder dissolved in a liquid.

A valve, which may be a check valve, may be arranged in the opening of the annular barrier 20 through which pressurised fluid enters to expand the annular barrier. A sleeve may be arranged between the downhole expandable metal tubular 1 and the tubular part 23. The sleeve is connected with the tubular part 23 and the downhole expandable metal tubular 1, thus dividing the annular space 25 into a first space section and a second space section. Furthermore, the downhole expandable metal tubular 1 may have an aperture providing fluid communication between the first zone 201 or the second zone 202 and one of the space sections in order to equalise the pressure in the space if the formation pressure rises when expansion has taken place. By being able to equalise the pressure across the downhole expandable metal tubular 1, pressure compensation during e.g. a subsequent fracturing process is provided.

The invention further relates to a downhole completion 100 comprising the well tubular structure 5 shown in FIG. 4, and the downhole expandable metal tubular forming a patch to be expanded therein.

The downhole completion 100 may also comprise the well tubular structure having an annular barrier 20, as shown in FIG. 3, where the downhole expandable metal tubular 1 forms the expandable part surrounding the tubular part 23 of the annular barrier which is mounted as part of the well tubular structure 22.

Figure 5:
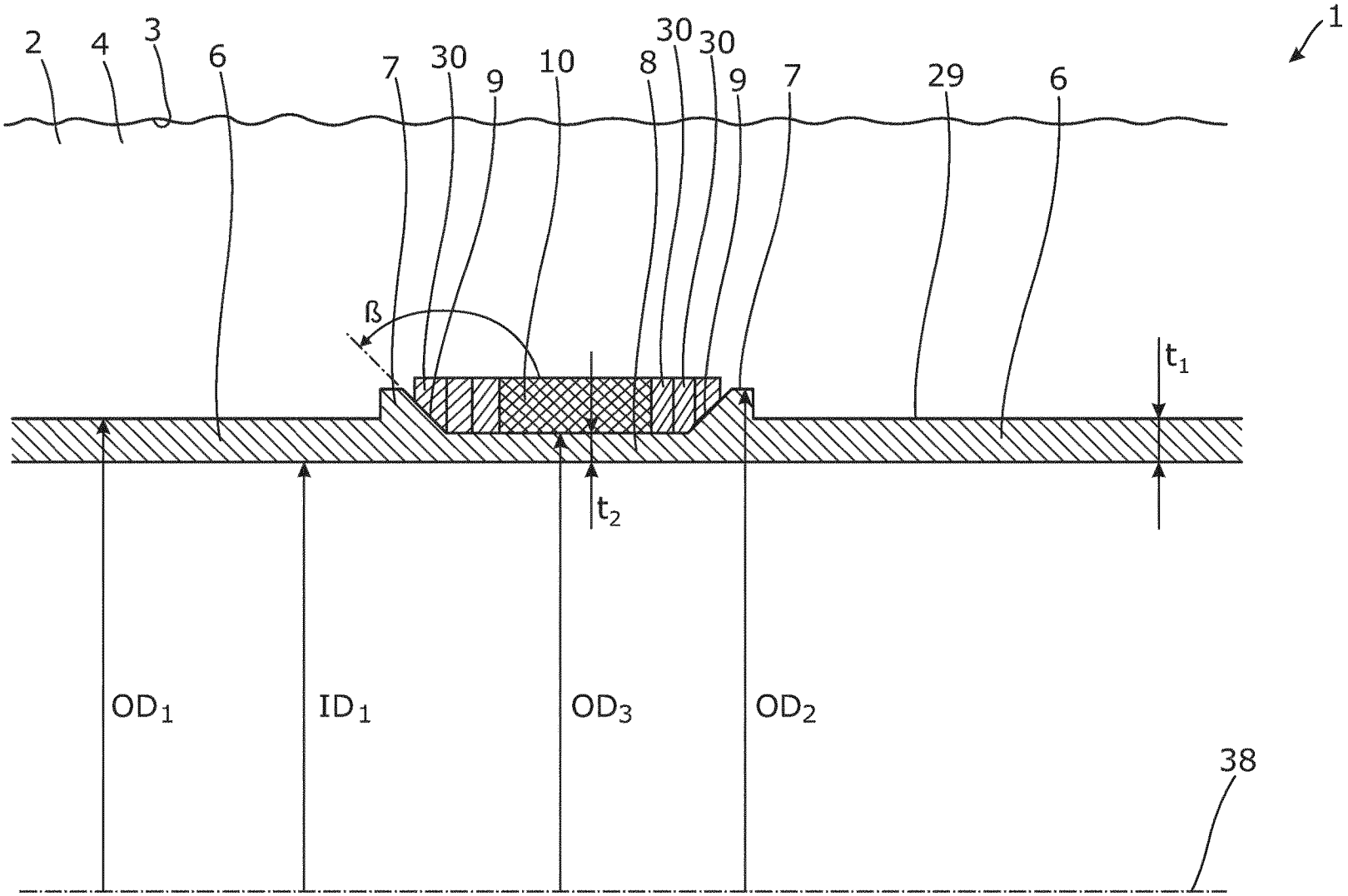
FIG. 5 shows a cross-sectional, partial view of a downhole expandable metal tubular having a split ring-shaped retaining element.

In FIG. 5, the downhole expandable metal tubular 1 has both the sealing element 10 and two split ring-shaped retaining elements 30 arranged between the projections 7. The split ring-shaped retaining elements 30 form a back-up for the sealing element so that when expanded, the split ring-shaped retaining elements 30 have more than one winding, meaning that when the downhole expandable metal tubular 1 is expanded from a first outer diameter to a second outer diameter, the windings of the split ring-shaped retaining elements 30 partly unwind. In the embodiment shown in FIG. 5, the split ring-shaped retaining elements 30 have three windings. However, in other embodiments, they may have two, four, five, six or seven windings, and an even higher number of windings is possible. The split ring-shaped retaining elements 30 and the sealing element 10 occupy the gap between the projections 7. Thus, the split ring-shaped retaining elements 30 abut the sealing element. Hereby, it is obtained that the split ring-shaped retaining elements 30 ensure that the sealing element 10 is maintained and supported in the longitudinal extension of the downhole expandable metal tubular 1, even during expansion, so that the sealing element 10 retains its intended position and the sealing properties of the downhole expandable metal tubular 1 are enhanced. Furthermore, tests have shown that the sealing element 10 may withstand a higher pressure on either of the sides where the split ring-shaped retaining elements are positioned because the split ring-shaped retaining elements function as a back-up and support system for the sealing element.

Figure 6:
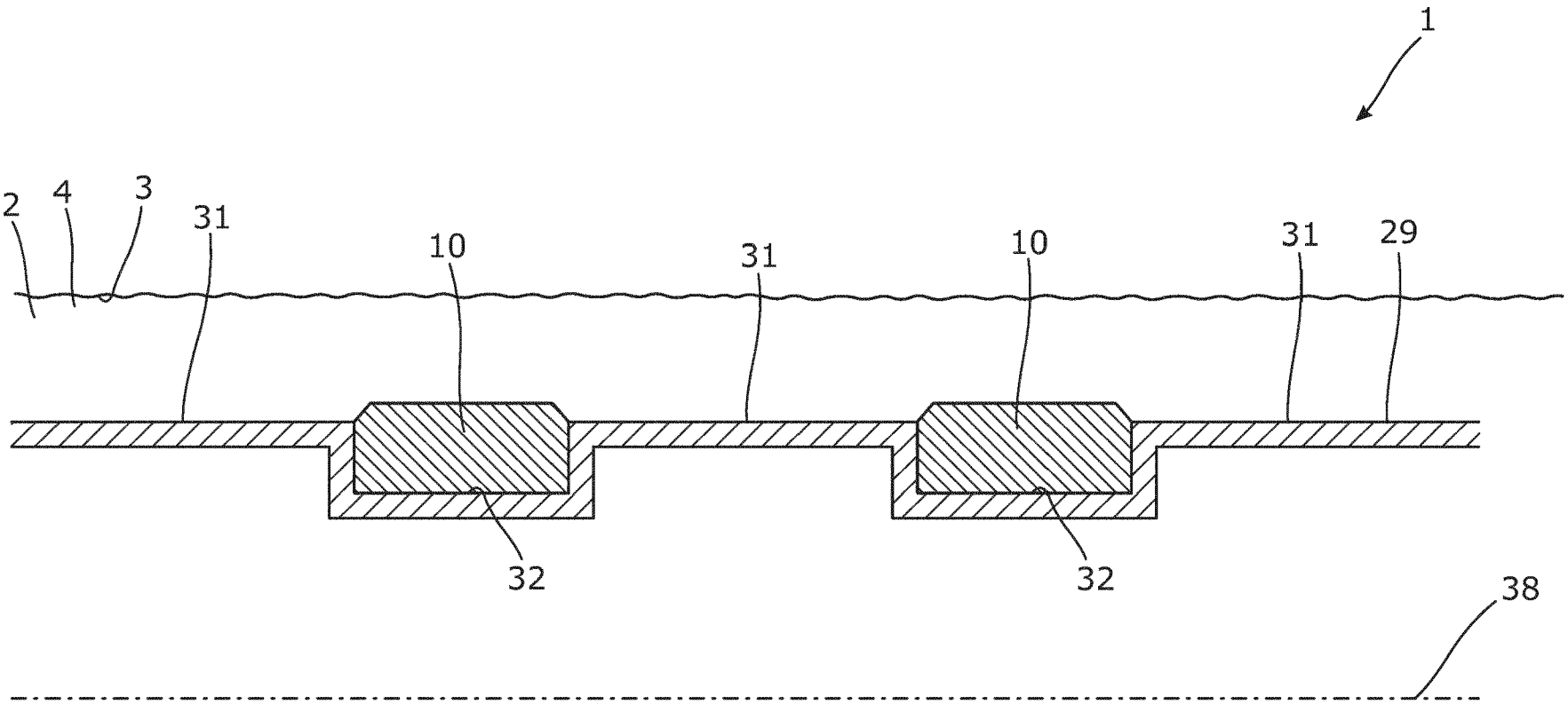
FIG. 6 shows a cross-sectional, partial view of a downhole expandable metal tubular being corrugated.

FIG. 6 shows a downhole expandable metal tubular 1 to be expanded in a well 2 downhole to abut an inner face 3 of a borehole 4. The downhole expandable metal tubular 1 is shown in its unexpected condition and has an axial extension 38. The downhole expandable metal tubular 1 is corrugated, thereby forming projections 31 and grooves 32, and the downhole expandable metal tubular has a substantially even thickness along the axial extension. By having projections 31 between the grooves 32 comprising sealing elements, the downhole expandable metal tubular 1 is expanded more evenly than if the downhole expandable metal tubular 1 also comprises grooves between the sealing elements 10.

In prior art downhole expandable metal tubulars, the part between the grooves are projections followed by grooves, and then, the material forming these intermediate grooves without sealing elements is free to expand, and expands more than the remaining part of the downhole expandable metal tubular and is thinned so that the collapse rating of the downhole expandable metal tubular is substantially decreased. Furthermore, by having a substantially even thickness along the axial extension, the expansion of the downhole expandable metal tubular is performed more evenly in the present solution of FIG. 6 and thus the collapse rating is substantially improved compared to prior art expandable tubulars.

When seen in cross-section along the axial extension, as in FIG. 6, the downhole expandable metal tubular 1 has square-shaped grooves 32. The projections 31 have an axial extension and a straight part substantially parallel to the axial extension 38. The grooves 32 have a smaller extension along the axial extension than the projections 31, and sealing elements 10 are arranged in the grooves so as to provide a better sealing ability when the downhole expandable metal tubular 1 is expanded to seal against the inner face 3 of the borehole.

Figure 7:
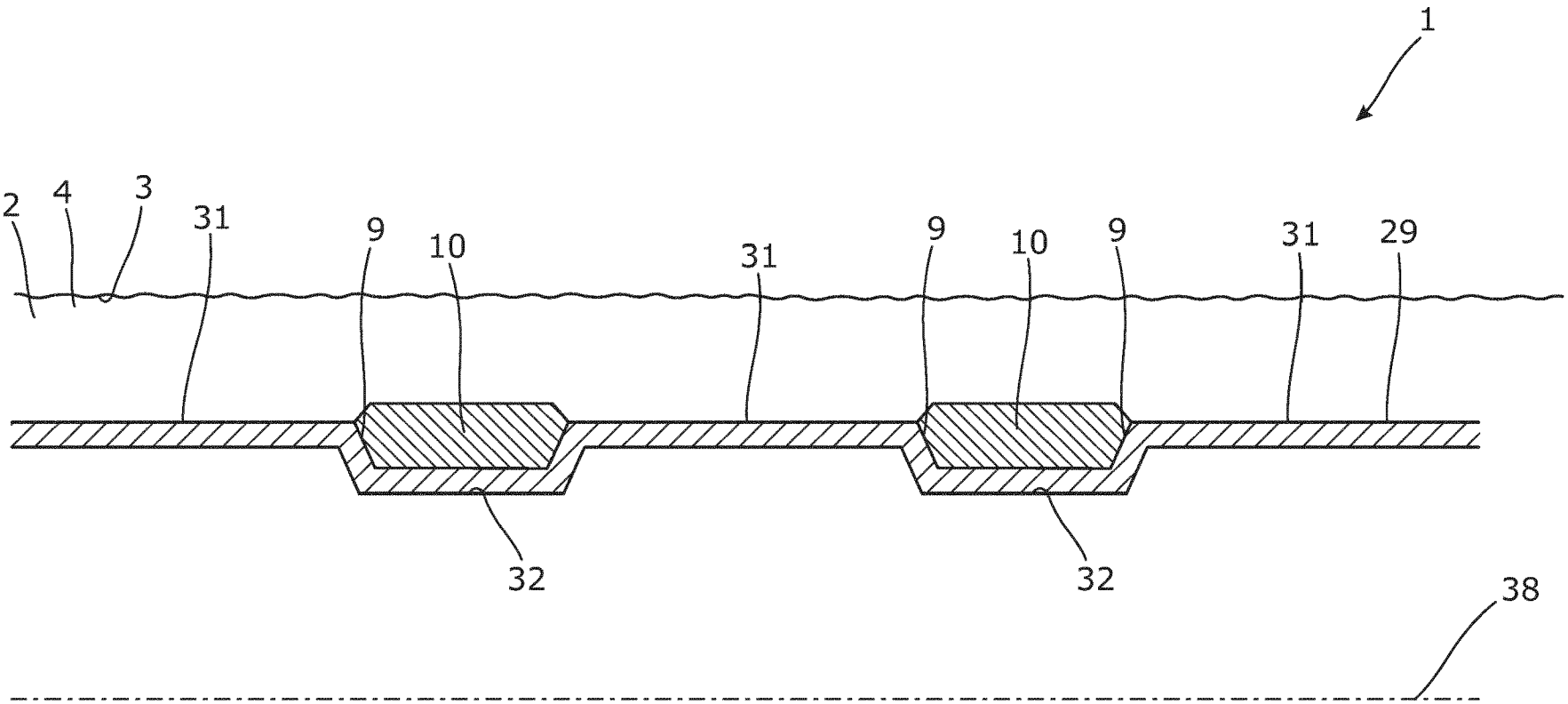
FIG. 7 shows a cross-sectional, partial view of another downhole expandable metal tubular being corrugated.

In FIG. 7, the downhole expandable metal tubular 1, when seen in cross-section along the axial extension, has a corrugated trapezoidal shape like a sheet piling. The grooves hereby have an inclined face 9 inclining from the projections 31 towards the groove 32.

Figure 9:
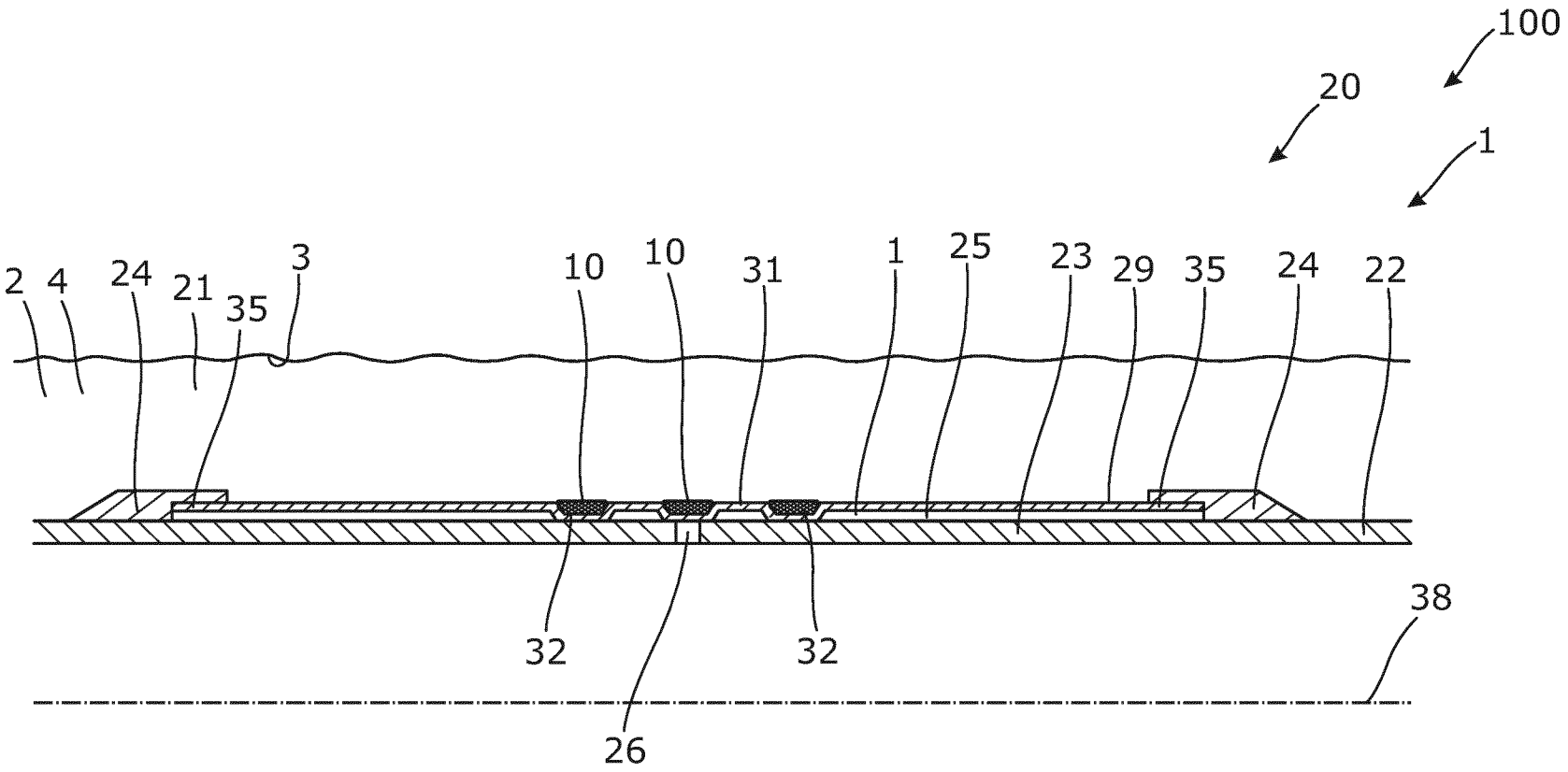
FIG. 9 shows a cross-sectional view of another annular barrier mounted as part of a well tubular structure.

In FIG. 9, the downhole expandable metal tubular 1 of FIG. 7 is part of an annular barrier 20. The annular barrier 20 is to be expanded in an annulus 21 between a well tubular structure 22 and the inner face 3 of the borehole 4 or a casing (not shown) downhole to provide zone isolation between a first zone and a second zone of the borehole 4 by dividing the annulus 21 into two parts, i.e. the first zone and the second zone. The annular barrier 20 comprises a tubular part 23 adapted to be mounted as part of the well tubular structure 22 and surrounds the tubular part and has an outer face 29 facing the inner face 3 of the borehole 4. Each end 35 of the downhole expandable metal tubular 1 is connected with the tubular part 23 by means of connection parts 24 defining an annular space 25 between the downhole expandable metal tubular 1 and the tubular part 23. The downhole expandable metal tubular 1 may in another embodiment be connected to the tubular part 23 by welding. The annular barrier 20 may be expanded by letting pressurised fluid into the space through the opening 26 in the tubular part 23 or by the annular space 25 comprising a compound adapted to expand the annular space in that the compound comprises at least one thermally decomposable compound or chemical reactant adapted to generate gas or super-critical fluid upon decomposition.

As can be seen in FIG. 9, the downhole expandable metal tubular 1 ends in projections 31 which are end projections, and the ends are connected to the tubular part 23 of the annular barrier 20. The projections 31 abut the inner face 3 of the borehole 4 almost simultaneously with the sealing elements 10, and the material of the projections is not expanded to such an extent that it becomes thinner than the remaining part of the downhole expandable metal tubular. Thus, the collapse rating is improved in relation to prior art solutions where the part of the downhole expandable metal tubular between the sealing elements is further away from the inner face of the borehole and thus able to expand more. In FIG. 9, the projections 31 between the grooves 32 are smaller in extension than the end projections.

Figure 8A:
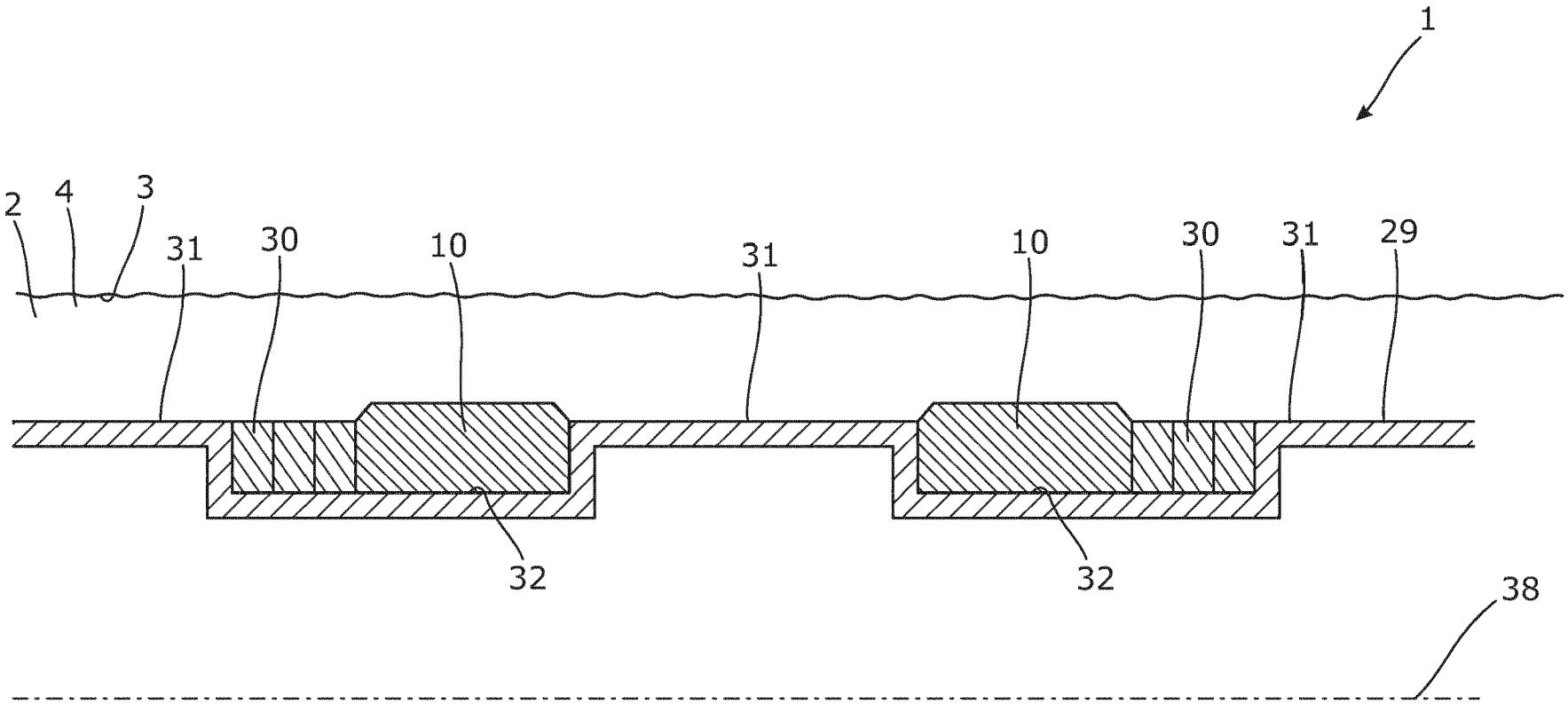
FIG. 8A shows a cross-sectional, partial view of a downhole expandable metal tubular being corrugated and having a split ring-shaped retaining element.

In FIG. 8A, both the sealing element 10 and a split ring-shaped retaining element 30 are arranged in at least one of the grooves 32, and the split ring-shaped retaining element forms a back-up for the sealing element. The split ring-shaped retaining element 30 has more than one winding, i.e. at least two in FIG. 8A, so that when the downhole expandable metal tubular 1 is expanded from the first outer diameter to the second outer diameter, the split ring-shaped retaining element partly unwinds. However, in other embodiments, it may have two, four, five, six or seven windings, and an even higher number of windings is possible. The split ring-shaped retaining element 30 and the sealing element 10 occupy the gap between the projections 31. Thus, the split ring-shaped retaining element 30 abuts the sealing element 10. Hereby, it is obtained that the split ring-shaped retaining element 30 ensures that the sealing element 10 is maintained and supported in the longitudinal extension of the downhole expandable metal tubular 1 even during expansion, so that the sealing element 10 retains its intended position and the sealing properties of the downhole expandable metal tubular 1 are enhanced. Furthermore, tests have shown that the sealing element may withstand a higher pressure on the side where the split ring-shaped retaining element is positioned, since the split ring-shaped retaining ring functions as a back-up and support system for the sealing element.

Figure 8B:
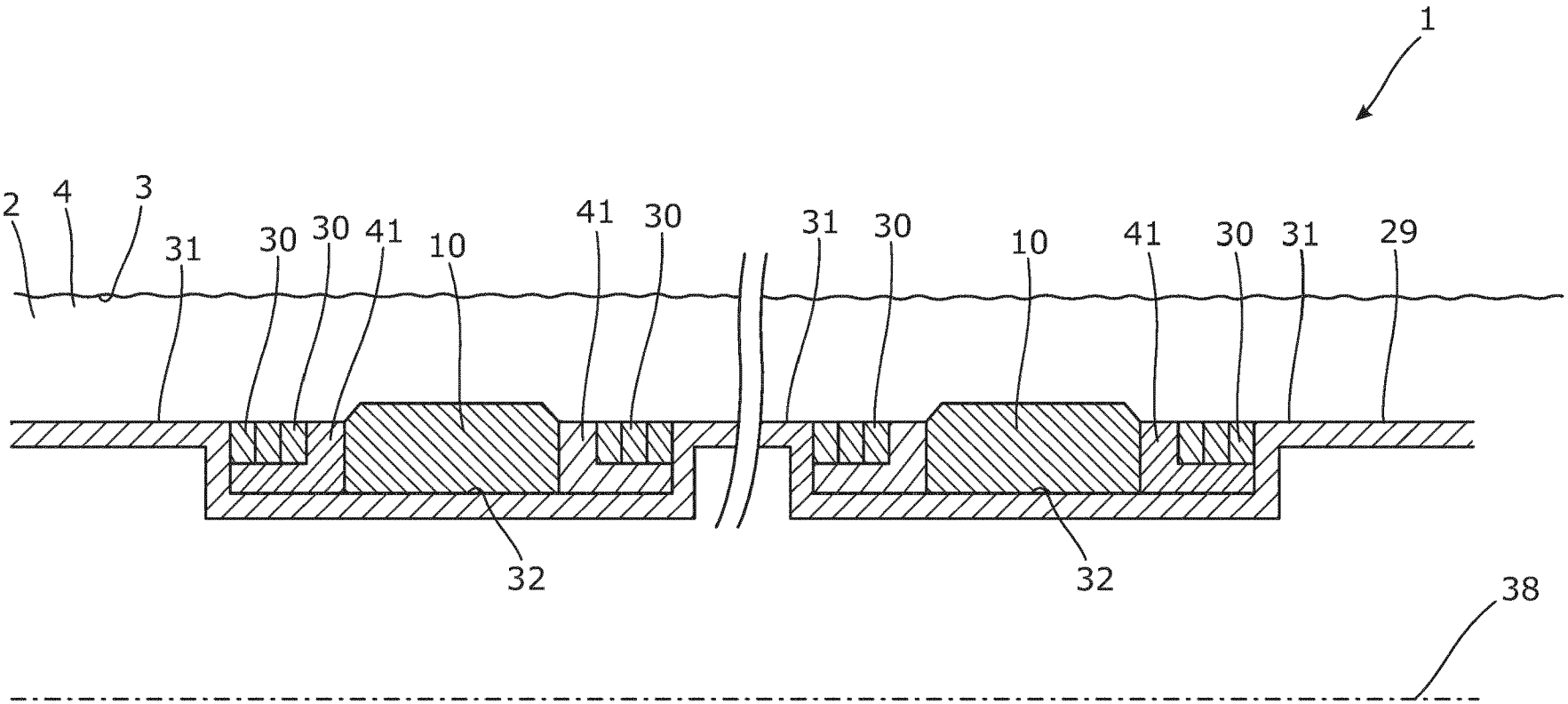
FIG. 8B shows a cross-sectional, partial view of another downhole expandable metal tubular being corrugated and having a split ring-shaped retaining element and an intermediate element.
Figure 10:
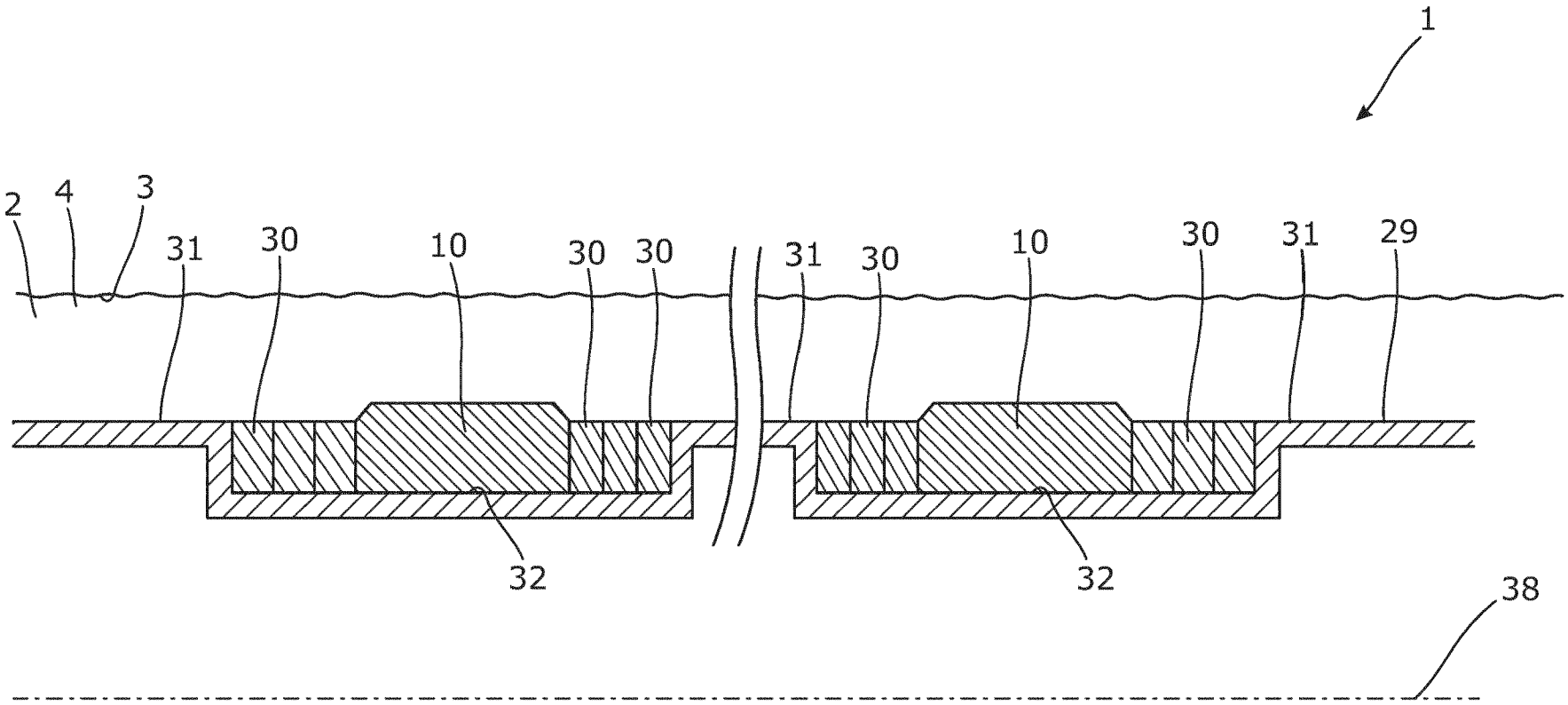
FIG. 10 shows a cross-sectional, partial view of another downhole expandable metal tubular being corrugated and having split ring-shaped retaining elements.

In FIG. 8B, an intermediate element 41 is arranged between the split ring-shaped retaining element 30 and the sealing element 10. In this embodiment, the split ring-shaped retaining element 30 partly overlaps the intermediate element 41. The intermediate element 41 may be made of a flexible material and is adapted to maintain the split ring-shaped retaining element 30 in position and function as protection and support of the sealing element 10. The split ring-shaped retaining element 30, the intermediate element 41 and the sealing element 10 are placed in the groove 32 between the first and second circumferential projections 31. The intermediate element 41 may be made of Teflon or a similar material being harder than that of the sealing element 10. Split ring-shaped retaining elements 30 may also be provided on either side of the sealing element 10, as shown in FIG. 10.

The downhole expandable metal tubular 1 is corrugated, thereby forming projections 31 and grooves 32, and has a corrugated cross-section like a sheet piling in the construction field. The downhole expandable metal tubular 1 is shaped e.g. by cold-working by means of rollers rotating within the downhole expandable metal tubular while being pressed towards the downhole expandable metal tubular forming the projections. Thus, the downhole expandable metal tubular is a sleeve having a substantially even thickness when seen in cross-section, as shown in FIGS. 7-9, and the downhole expandable metal tubular is formed of projections 31 and grooves 32. The projections 31 have a straight part, and the grooves have a straight part when seen in cross-section.

Figure 11:
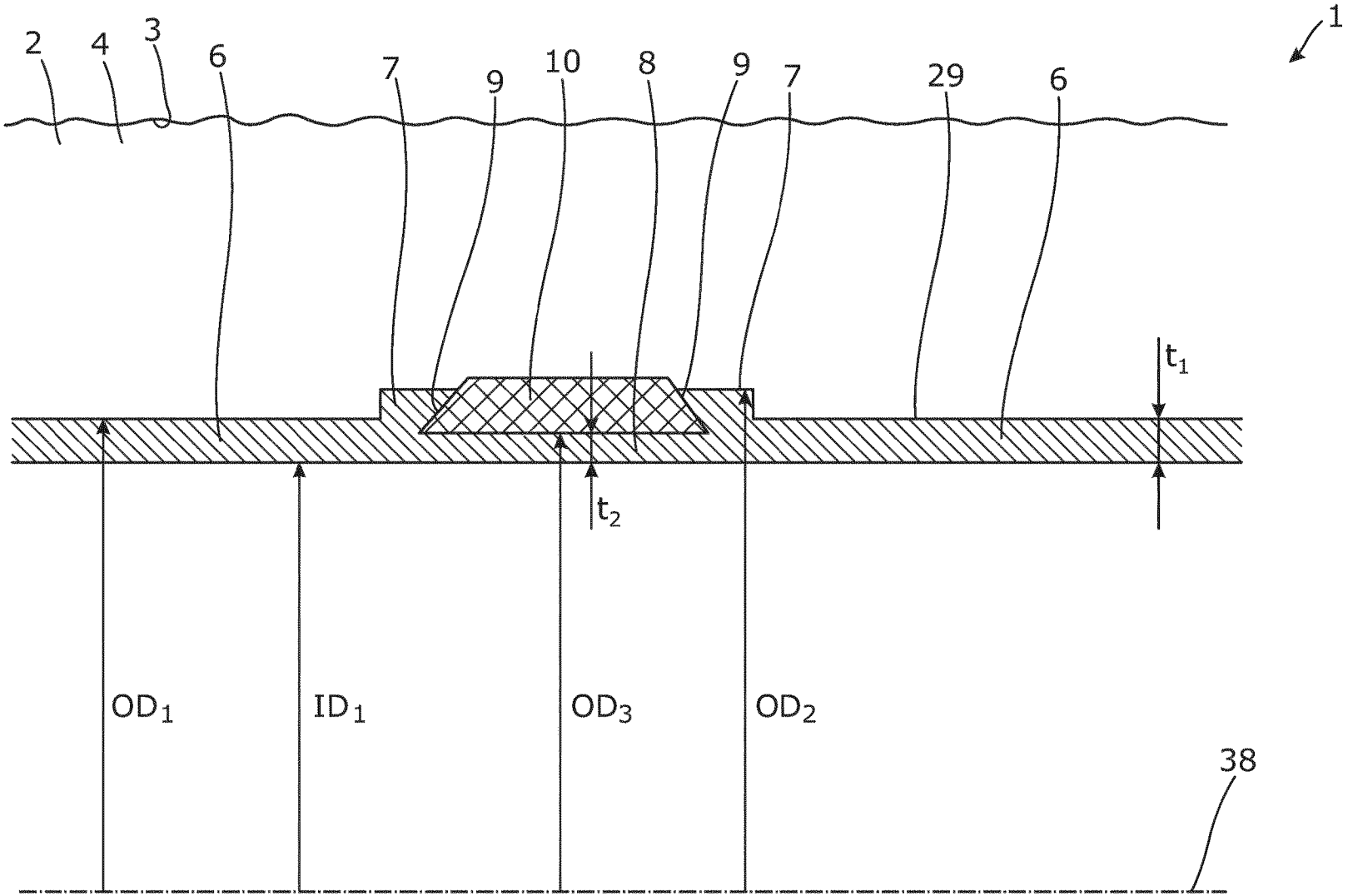
FIG. 11 shows a cross-sectional, partial view of another downhole expandable metal tubular in an unexpanded condition.

In FIG. 11, the downhole expandable metal tubular 1 comprises the second section 8 arranged between the two projections 7, and each projection has an inclined face 9 tapering from the second section 8 towards the second outer diameter $OD_2$ and is thus inclining in a direction opposite that of the downhole expandable metal tubular 1 shown in FIG. 1.

Figure 12:
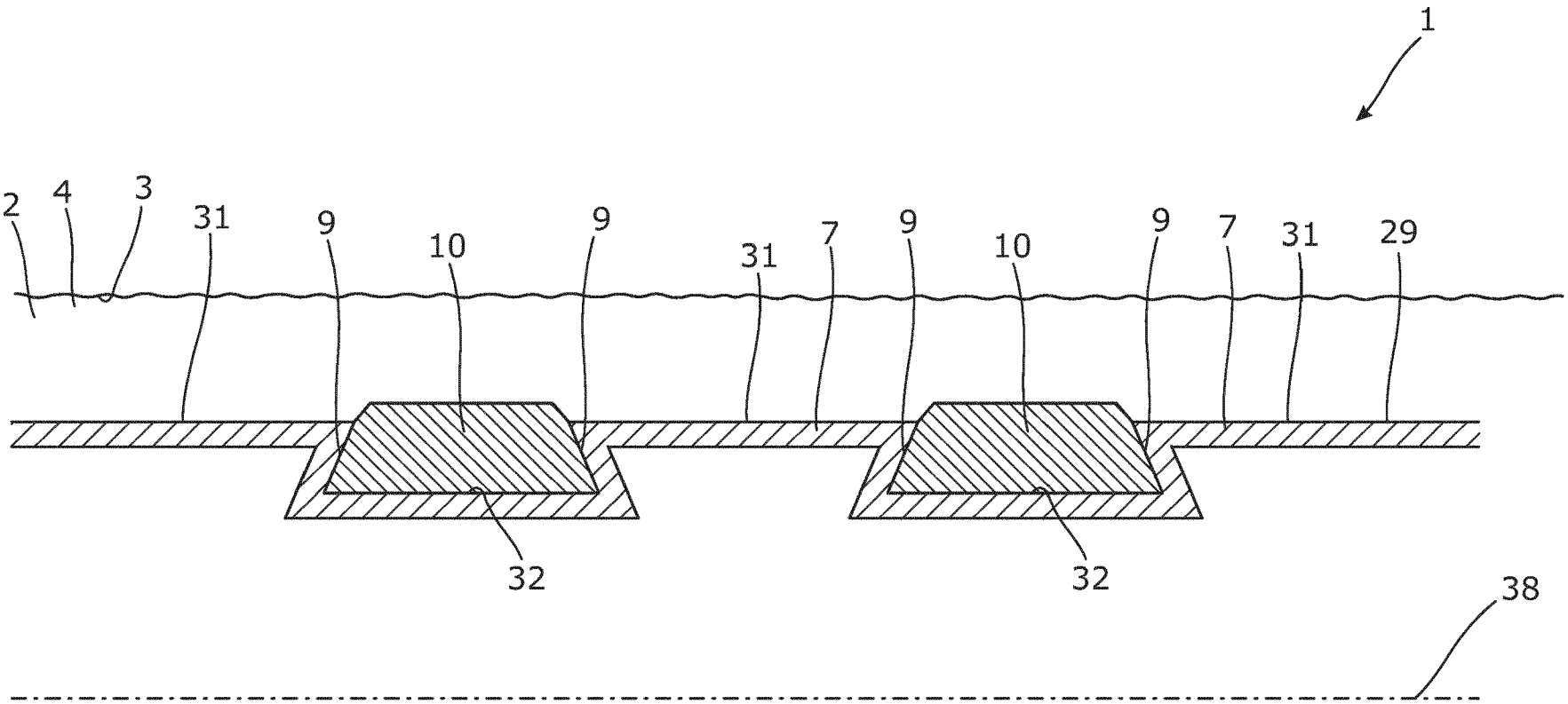
FIG. 12 shows a cross-sectional, partial view of another downhole expandable metal tubular.

In FIG. 12, the inclined face 9 is also inclining in a direction opposite that of the downhole expandable metal tubular 1 shown in FIG. 1, and the downhole expandable metal tubular 1 has a corrugated cross-section like a sheet piling. By having the inclined face 9 inclining in the opposite direction, thus minimising the space radially outwards, the sealing element 10 is maintained in place, even during expansion, e.g. when the downhole expandable metal tubular 1 functions as the expandable sleeve of an annular barrier.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, a production casing or a well tubular structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole expandable metal tubular having an axial extension, to be expanded in a well downhole to abut an inner face of a casing or a borehole, comprising:

a first section of a metal material having a first outer diameter, two circumferential projections of said metal material having a second outer diameter which is larger than the first outer diameter, and a second section of said metal material arranged between the two projections, each projection having an inclined face tapering from the second outer diameter towards the second section, wherein the first section, the projections and the second section form a one piece construction of said metal material, and wherein the second section has a third outer diameter which is smaller than the first outer diameter in an unexpanded condition, and a sealing element is arranged between the projections opposite the second section so that during expansion, the second section bulges more radially outwards than the first section, forcing the sealing element radially outwards in an expanded condition.

2. A downhole expandable metal tubular according to claim 1, wherein the expandable metal tubular has an inner diameter which is the same along the axial extension in the unexpanded condition.

3. A downhole expandable metal tubular according to claim 1, wherein the first section has a first thickness and the second section has a second thickness, the second thickness being at least 25% smaller than the first thickness.

4. A downhole expandable metal tubular according to claim 1, wherein the inclined face of the projections forms an angle in relation to the axial extension, said angle being at least 110°, when the second section is in the expanded condition.

5. A downhole expandable metal tubular according to claim 1, wherein the sealing element is arranged in the second section, the second section including the sealing element has an outer diameter which is substantially the same as the second outer diameter of the projections.

6. An annular barrier to be expanded in an annulus between a well tubular structure and an inner face of a borehole or a casing downhole for providing zone isolation between a first zone and a second zone of the borehole, the annular barrier comprising:

a tubular part adapted to be mounted as part of the well tubular structure, a downhole expandable metal tubular according to claim 1, surrounding the tubular part and having an outer face facing the inner face of the borehole or the casing, each end of the downhole expandable metal tubular being connected with the tubular part, and an annular space between the downhole expandable metal tubular and the tubular part.

7. A downhole completion comprising:

a well tubular structure, and a downhole expandable metal tubular according to claim 1.

8. A downhole completion comprising:

the well tubular structure, and an annular barrier according to claim 6, wherein the tubular part of the annular barrier is mounted as part of the well tubular structure.

9. A sealing expansion method comprising:

arranging a downhole expandable metal tubular according to claim 1 opposite an area to be sealed off, and expanding the downhole expandable metal tubular to abut the area and thereby sealing off the area.

10. A sealing expansion method comprising:

arranging a downhole completion according to claim 8, and expanding the downhole expandable metal tubular of the annular barrier to abut a casing or a borehole in order to provide zone isolation between a first zone and a second zone of the casing or the borehole.

* * * * *